US006410814B2

(12) United States Patent
Fujimoto et al.

(10) Patent No.: US 6,410,814 B2
(45) Date of Patent: Jun. 25, 2002

(54) PROCESS FOR SYNTHESIS OF LOWER ISOPARAFFINS FROM SYNTHESIS GAS

(75) Inventors: Kaoru Fujimoto; Noritatsu Tsubaki, both of Tokyo-to (JP)

(73) Assignees: Toyota Jidosha Kabushiki Kaisha, Toyota; Genesis Research Institute, Inc., Nagoya, both of (JP)

( * ) Notice: Subject to any disclaimer, the term of this patent is extended or adjusted under 35 U.S.C. 154(b) by 0 days.

(21) Appl. No.: 09/824,144

(22) Filed: Apr. 3, 2001

(30) Foreign Application Priority Data

Apr. 4, 2000 (JP) ..... 2000-102047

(51) Int. Cl.[7] ..... C07C 1/04; C07C 5/22; C07C 5/13; C10G 65/02; C10G 64/02

(52) U.S. Cl. ..... 585/733; 585/310; 585/700; 585/734; 585/737; 585/752; 208/44; 208/54

(58) Field of Search ..... 585/310, 700, 585/733, 734, 737, 752; 208/44, 54

(56) References Cited

FOREIGN PATENT DOCUMENTS

JP 61-23688 2/1986

OTHER PUBLICATIONS

Fujimoto et al, "Direct Synthesis of Isoparaffins from Synthesis Gas"; *Chemistry Letters* (1985) pp. 783–786.

*Primary Examiner*—Thuan D. Dang
(74) *Attorney, Agent, or Firm*—Burns, Doane, Swecker & Mathis, LLP

(57) ABSTRACT

A process for synthesis of lower isoparaffins from synthesis gas that is a mixture of hydrogen and carbon monoxide, wherein straight chain hydrocarbons are synthesized while isoparaffins and isoolefins are also produced through decomposition of hydrocarbons having a higher carbon number by use of a solid acid catalyst in the first stage, and isoparaffins are synthesized in the second stage. The straight chain hydrocarbons are produced by contacting the synthesis gas with a Fischer-Tropsch synthesis catalyst that is mixed with a solid acid catalyst for mainly hydrocracking long chain hydrocarbons. The isoparaffins are produced by contacting the straight chain hydrocarbons synthesized in the first stage, with a mixture of a hydrogenation catalyst for hydrogenating olefins and a solid acid catalyst for hydrocracking and isomerizing the straight chain hydrocarbons.

18 Claims, 6 Drawing Sheets

PROCESS FOR SYNTHESIS OF LOWER ISOPARAFFINS FROM SYNTHESIS GAS

INCORPORATION BY REFERENCE

The disclosure of Japanese Patent Application No. 2000-102047 filed on Apr. 4, 2000, including the specification, drawings and abstract, is incorporated herein by reference in its entirety.

BACKGROUND OF THE INVENTION

1. Field of the Invention

The invention relates generally to an improvement in the process for synthesis of lower isoparaffins from synthesis gas (hereinafter referred to as "syngas" when appropriate) which is a mixture of hydrogen and carbon monoxide.

2. Description of Related Art

Processes for producing lower aliphatic saturated hydrocarbons (lower paraffins) from syngas (i.e., a mixture of hydrogen and carbon monoxide) are well known in the art. An example of the known processes uses a catalyst that is a physical mixture of a methanol synthesis catalyst based on, for example, Cu—Zn, Cr—Zn, Pd, or the like, with a methanol conversion catalyst comprising, for example, zeolite. In this method, the syngas is converted to lower aliphatic saturated hydrocarbons via methanol in one pass through the above-mentioned catalyst. This process for producing lower aliphatic saturated hydrocarbons via methanol, however, suffers from problems, such as severe reaction conditions, deactivation of the catalyst, and low selectivity for components whose carbon number is equal to or greater than 4 (i.e., at least C4 components).

Meanwhile, a process has been proposed for producing lower isoparaffins under relatively mild reaction conditions without causing syngas to be converted to methanol during the process. This process uses a catalyst for Fischer-Tropsch (FT) synthesis for synthesizing higher paraffins and lower olefins from syngas, and uses a solid acid catalyst, such as zeolite, for producing lower isoparaffins by hydrocracking or isomerizing the higher paraffins and lower olefins. This process for synthesis of lower isoparaffins is disclosed in "DIRECT SYNTHESIS OF ISOPARAFFINS FROM SYNTHESIS GAS", Kaoru FUJIMOTO et al., CHEMISTRY LETTERS, pp. 783–786, 1985.

The aforementioned process uses a mixed catalyst that is a mixture of the FT synthesis catalyst and the solid acid catalyst such as zeolite as described above, so as to produce lower isoparaffins from syngas in one pass through the mixed catalyst. The resultant lower isoparaffins have a high octane number and are suitable for use as high-performance transportation fuel.

In the process for synthesis of lower isoparaffins using the known FT synthesis reaction as described above, the optimal temperature for the synthesis reaction on a cobalt catalyst as one type of the FT synthesis catalyst is in the range of 240 to 260° C., whereas the optimal temperature for the hydrocracking reaction on zeolite as one type of the solid acid catalyst is in the range of 280 to 320° C. Thus, there is a great difference in the optimal temperature range between the above two reactions. In other words, the one-pass reaction for synthesis of lower isoparaffins suffers from a mismatch in the optimal temperature range between the FT synthesis catalyst and the solid acid catalyst.

If the synthesis of lower isoparaffins is carried out at a temperature in the range of 280 to 320° C., which is the optimal temperature range for the hydrocracking reaction, the selectivity for methane in the FT synthesis reaction may undesirably increase.

If the synthesis of lower isoparaffins is carried out at a temperature in the range of 240 to 260° C., which is the optimal temperature range for the FT synthesis reaction, on the other hand, the selectivity for methane may be reduced, but there may arise other problems as follows: the selectivity factor for isoparaffins is reduced due to an insufficient ability of the solid acid catalyst to achieve hydrocracking, and the carbon numbers of hydrocarbons produced in this manner are distributed over an extended or larger range.

SUMMARY OF THE INVENTION

It is an object of the invention to provide a process for synthesis of lower isoparaffins from synthesis gas wherein synthesis reactions are conducted at temperatures most suitable for respective types of catalysts so that the selectivity for lower isoparaffins as a target product can be increased.

To accomplish the above and other objects, the invention provides a process for synthesis of lower isoparaffins from synthesis gas that is a mixture of hydrogen and carbon monoxide, comprising the steps of: (1) synthesizing straight chain hydrocarbons in a first stage by contacting the synthesis gas with a Fischer-Tropsch synthesis catalyst that is mixed with a solid acid catalyst for mainly hydrocracking long chain hydrocarbons, and (2) synthesizing isoparaffins in a second stage by contacting the straight chain hydrocarbons synthesized in the first stage, with a mixture of a hydrogenation catalyst for hydrogenating olefins and a solid acid catalyst for hydrocracking and isomerizing the straight chain hydrocarbons.

In the process as described above, the Fischer-Tropsch synthesis catalyst may be cobalt (Co) supported by silica or $CoMnO_2$ prepared by a coprecipitation method.

In the process as described above, the hydrogenation catalyst may be paradium (Pd) or platinum (Pt) supported by silica or active carbon, for example.

In the process as described above, the hydrogenation catalyst may be paradium (Pd) or platinum (Pt) directly supported by, for example, zeolite serving as the solid acid catalyst.

In the process as described above, hydrogen may be added to the second stage in which the isoparaffins are synthesized.

In the process as described above, synthesis of the straight chain hydrocarbons in the first stage may be carried out at a temperature in a range of 240 to 260° C., and synthesis of the isoparaffins in the second stage may be carried out at a temperature in a range of 280 to 320° C.

BRIEF DESCRIPTION OF THE DRAWINGS

The invention will be described in conjunction with the following drawings in which.

DETAILED DESCRIPTION OF PREFERRED EMBODIMENT(S)

Figure 1:
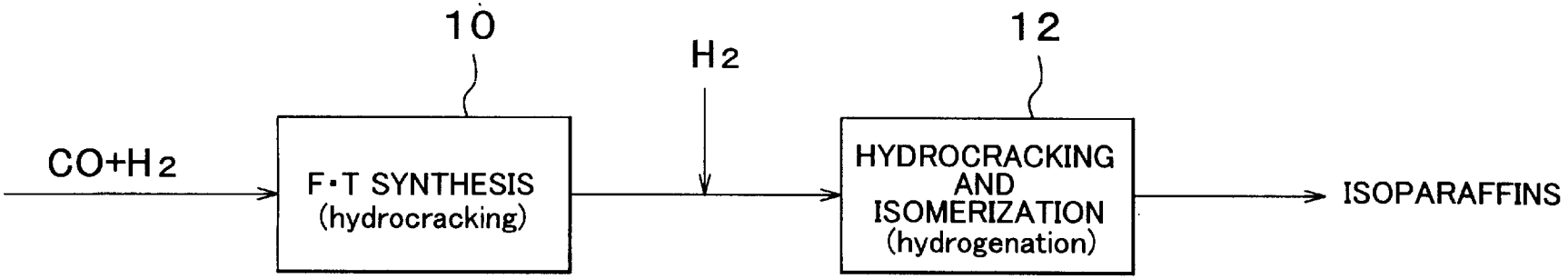
FIG. 1 is a schematic view showing an apparatus or system for carrying out a process for synthesis of lower isoparaffins from synthesis gas according to the invention.

An embodiment of the invention will be described referring to the drawings.

FIG. 1 shows an example of an arrangement or system for carrying out a process for synthesis of lower isoparaffins from synthesis gas or syngas according to the invention. In FIG. 1, syngas, which is a mixture of hydrogen and carbon monoxide, is supplied to a first reaction vessel 10 in which first-stage reactions of the invention take place, namely, straight chain hydrocarbons are produced through the Fischer-Tropsch (FT) synthesis. The straight chain hydrocarbons thus produced in the first reaction vessel 10 are then supplied to a second reaction vessel 12 in which second-stage reactions of the invention take place, namely, the straight chain hydrocarbons are hydrocracked and isomerized to thereby produce isoparaffins.

With a synthesis gas, which may be a mixture of hydrogen and carbon monoxide, being fed to the first reaction vessel 10, the FT synthesis is carried out in the vessel 10, using an FT synthesis catalyst, at a temperature in the range of 240 to 260° C. and a pressure of approximately 10 to 30 atm. In the reaction vessel 12, a suitable catalyst is used for causing the second-stage reactions at a temperature in the range of 280 to 320° C. and the same pressure as in the reaction vessel 10. It is thus possible to cause the above-described reactions to take place under temperature conditions that are most suitable for the respective catalysts, thus improving the selectivity for lower isoparaffins to a desired level.

By adding hydrogen into the second reaction vessel 12 to compensate for its deficiency in terms of the quantity, the second-stage reactions, i.e., hydrocracking and isomerization, can be more actively realized with high stability.

The first reaction vessel 10 for the first-stage reactions contains a mixture of the FT synthesis catalyst for the FT synthesis reaction, with a solid acid catalyst for hydrocracking a wax component, or long chain hydrocarbon, generated in the FT synthesis reaction. The FT synthesis catalyst may be selected from, for example, a cobalt-based catalyst in which cobalt is supported by silica, and $CoMnO_2$ prepared by a coprecipitation method.

To provide the above-indicated catalyst in which cobalt is supplied by silica, silica gel may be impregnated with an aqueous solution of cobalt nitrate, for example. Preferably, the amount of cobalt thus supported is about 20 wt. %.

The $CoMnO_2$ may be prepared in the coprecipitation method, e.g., by dropping sodium carbonate serving as a precipitant into a mixed solution of cobalt nitrate and manganese nitrate, adjusting pH to be equal to about 8, and calcining the resulting mixture in the air at 400° C. In this case, the weight ratio of Co to $MnO_2$ is preferably 20:80 ($Co:MnO_2$=20:80).

When $CoMnO_2$ prepared by the coprecipitation method, rather than cobalt supported by silica, is used as the FT synthesis catalyst, the selectivity for methane ($CH_4$) is reduced as compared with the case where the cobalt-supported catalyst is used. For instance, where the cobalt supported by silica was used as the FT synthesis catalyst, the selectivity for methane in the FT synthesis at 240° C. and 10 atm with $H_2/CO$=3.0 was about 25%. Where the $CoMnO_2$ prepared by the coprecipitation method was used, the selectivity for methane remained as low as about 13%.

The FT synthesis catalyst may also be selected from molten iron catalysts and precipitated iron catalysts, in addition to the above-mentioned catalysts.

It is preferable to use zeolite, such as MFI (trade name: H-ZSM-5), as the solid acid catalyst to be mixed with the FT synthesis catalyst.

With the FT synthesis catalyst and the solid acid catalyst thus combined as described above, a wax component in the form of long chain hydrocarbons generated by the FT synthesis reaction may be decomposed by the solid acid catalyst, such as zeolite, in the first reaction vessel 10. This makes it possible to prevent or reduce the possibility of deactivation of the FT synthesis catalyst due to accumulation of wax on the surface of the FT synthesis catalyst, such as the cobalt-supported catalyst, thus permitting stable FT synthesis reactions. Since the reactivity of the solid acid catalyst in the wax decomposition is increased as the carbon number of the wax increases, long chain hydrocarbons that mainly provide a wax component may be decomposed by the solid acid catalyst.

Referring back to FIG. 1, the second reaction vessel 12 for the second-stage reactions contains a mixture of a hydrogenation catalyst for hydrogenating olefins contained in the hydrocarbons supplied from the first reaction vessel 10, and a solid acid catalyst for hydrocracking and isomerizing straight chain hydrocarbons supplied from the first reaction vessel 10. The mixture ratio of the hydrogenation catalyst to the solid acid catalyst is preferably about 1 to 4, but is not limited to this ratio.

A noble metal may be used as the hydrogenation catalyst. In particular, palladium (Pd) supported by silica is preferably used.

As the solid acid catalyst for use in the second reaction vessel 12, zeolite selected from, for example, H-USY, H-β, H-Y, H-ZSM-5, and H-Mor (mordenite), may be used.

The hydrogenation catalyst used in the second reaction vessel 12 is not limited to palladium supported by silica as described above, but may also be favorably provided by a noble metal, such as palladium (Pd) or platinum (Pt), which is directly supported by zeolite, or the like, which serves as the solid acid catalyst.

In the second reaction vessel 12, hydrogen atoms or hydrogen ions are produced on the hydrogenation catalyst, and the hydrogen atoms or ions thus produced serve to hydrogenate olefins contained in the product of the FT synthesis supplied from the first reaction vessel 10. As a result, tar, or the like, which would otherwise be produced due to polymerization of olefins, is prevented from adhering to the surface of the solid acid catalyst, thus suppressing or preventing deterioration of the catalytic activation of the solid acid catalyst.

Figure 2:
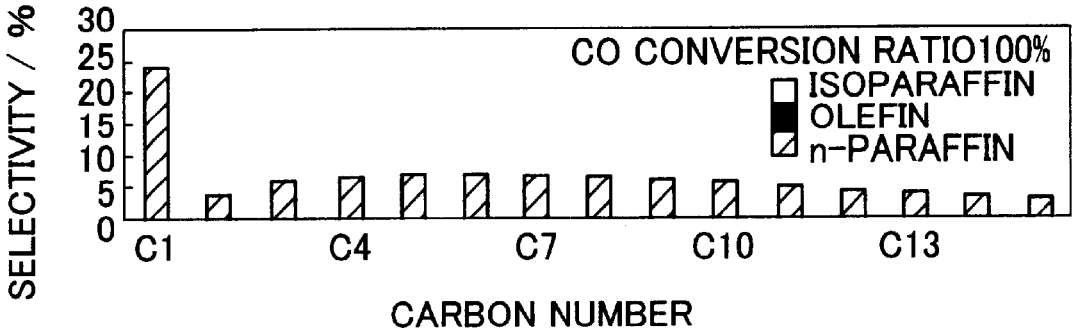
FIG. 2 is a graphical representation showing the selectivity (%) for respective types of hydrocarbons when FT synthesis in the first reaction stage was conducted by using only an FT synthesis catalyst and $H_2/CO$ was equal to 3.0.
Figure 3:
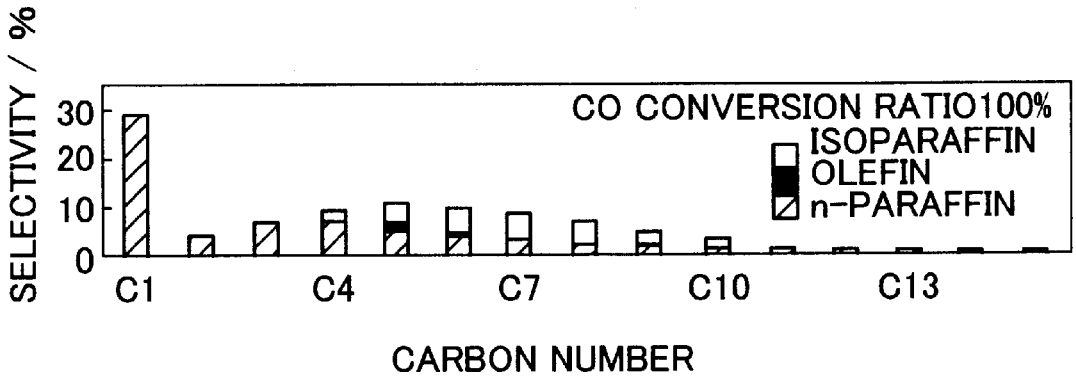
FIG. 3 is a graphical representation showing the selectivity (%) for respective types of hydrocarbons when FT synthesis in the first reaction stage was conducted by using a mixture of an FT synthesis catalyst with a solid acid catalyst and $H_2/CO$ was equal to 3.0.

FIGS. 2 to 5 show the study results on the effect of hydrocracking of the solid acid catalyst in the first reaction vessel 10. FIG. 2 shows the selectivity (%) for hydrocarbons having different carbon numbers, which hydrocarbons were produced by the FT synthesis using a catalyst that consists solely of cobalt supported by silica as the FT synthesis catalyst, at a reaction temperature of 240° C. and a reaction pressure of 10 atm. The FT synthesis was carried out while synthesis gas having the mixture ratio of $H_2/CO=3.0$ was fed to the first reaction vessel 10 in an amount of 0.2 mol per hour with respect to 1 g of the FT synthesis catalyst. FIG. 3 shows the selectivity (%) for hydrocarbons having different carbon numbers, which hydrocarbons were produced under the same reaction conditions as described above, using a catalyst prepared by adding 20 wt. % of H-ZSM-5 zeolite to the FT catalyst (cobalt supported catalyst).

Figure 4:
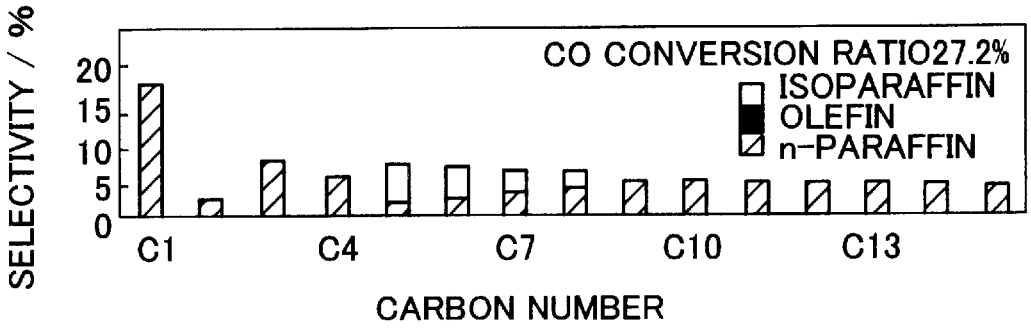
FIG. 4 is a graphical representation showing the selectivity (%) for respective types of hydrocarbons when FT synthesis in the first reaction stage was conducted by using only the FT synthesis catalyst and $H_2/CO$ was equal to 1.2.
Figure 5:
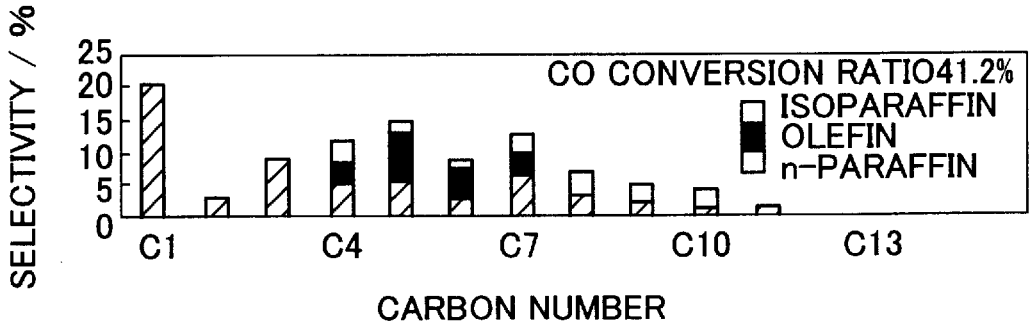
FIG. 5 is a graphical representation showing the selectivity (%) for respective types of hydrocarbons when FT synthesis in the first reaction stage was conducted by using a mixture of the FT synthesis catalyst with the solid acid catalyst and $H_2/CO$ was equal to 1.2.

FIG. 4 shows the result obtained in the case where the FT synthesis was conducted in the first reaction vessel 10 to which syngas whose ratio $H_2/CO$ is equal to 1.2 was supplied, using a catalyst to which no zeolite as a solid acid catalyst was added as in the case of FIG. 2. FIG. 5 shows the result obtained in the case where the FT synthesis was conducted in the first reaction vessel 10 to which syngas whose ratio $H_2/CO$ is equal to 1.2 was supplied, using a catalyst prepared by adding 20 wt. % of H-ZSM-5 zeolite to the FT synthesis catalyst as in the case of FIG. 3.

Comparisons between the results of FIG. 2 and FIG. 3 and those of FIG. 4 and FIG. 5 reveal that the use of the catalyst to which H-ZSM-5 zeolite serving as a solid acid catalyst was added results in a significant reduction in the selectivity for long chain hydrocarbons. It will be understood from this result that zeolite added to the catalyst serves to mainly decompose long chain hydrocarbons, or a wax component.

FIGS. 2 to 5 show the selectivity (%) for isoparaffins, olefins, and normal paraffins (n-paraffins), respectively, with respect to the hydrocarbons of each carbon number. Since hydrocracking and isomerization as well as the FT synthesis occur in the first reaction vessel 10 due to the addition of zeolite serving as a solid acid catalyst in the cases of FIG. 3 and FIG. 5, the proportion of isoparaffins as well as that of n-paraffins is increased.

FIGS. 6 to 9 show the results of analysis on the selectivity of the product discharged from the second reaction vessel 12 when the hydrocarbons synthesized by the FT synthesis catalyst mixed with the solid acid catalyst in the first reaction vessel 10 were introduced into the second reaction vessel 12 containing a mixture of the hydrogenation catalyst and the solid acid catalyst for hydrogenation of olefins and hydrocracking and isomerization of straight chain hydrocarbons. In this example, the catalyst used in the first reaction vessel 10 was a mixture of cobalt supported by silica serving as a FT synthesis catalyst and H-ZSM-5 zeolite serving as a solid acid catalyst. In the second reaction vessel 12, one selected from various types of zeolite was used as a solid acid catalyst, and palladium (Pd) supported by silica was used as a hydrogenation catalyst.

The reaction conditions were as follows: the reaction temperature and pressure in the first reaction vessel 10 were controlled to 250° C. and 10 atm, respectively, and the temperature and pressure in the second reaction vessel 12 were controlled to 300° C. and 10 atm, respectively. The composition ratio of syngas supplied to the first reaction vessel 10 was $H_2/CO=1.8$, and the syngas was supplied to the vessel 10 in an amount of 0.2 mol per hour with respect to 1 gram of the FT synthesis catalyst.

Figure 6:
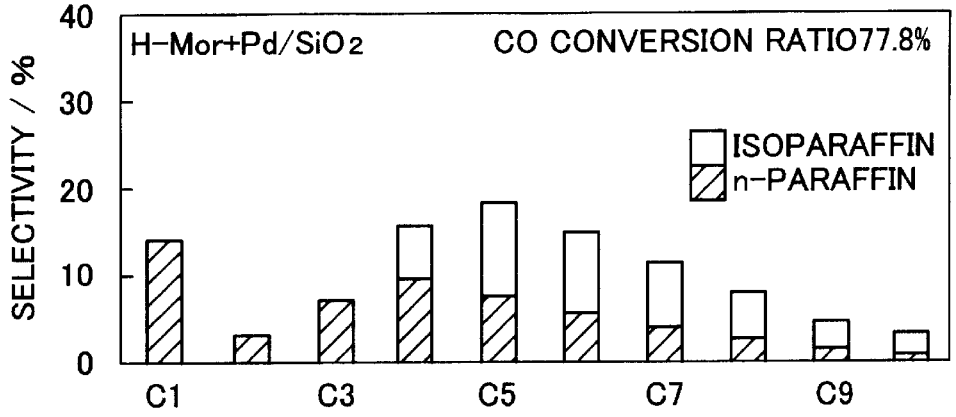
FIG. 6 is a graphical representation showing the selectivity (%) for respective types of hydrocarbons when H-mordenite was used as a solid acid catalyst in the second reaction stage.
Figure 7:
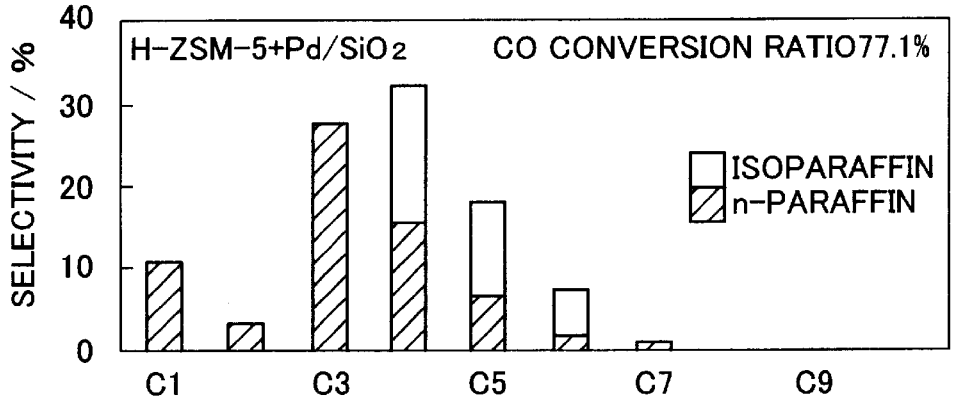
FIG. 7 is a graphical representation showing the selectivity (%) for respective types of hydrocarbons when H-ZSM-5 was used as a solid acid catalyst in the second reaction stage.
Figure 8:
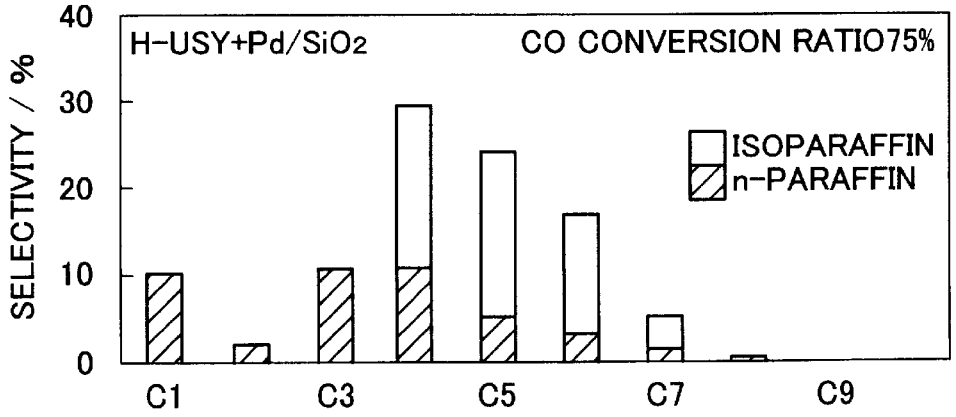
FIG. 8 is a graphical representation showing the selectivity (%) for respective types of hydrocarbons when H-USY was used as a solid acid catalyst in the second reaction stage.
Figure 9:
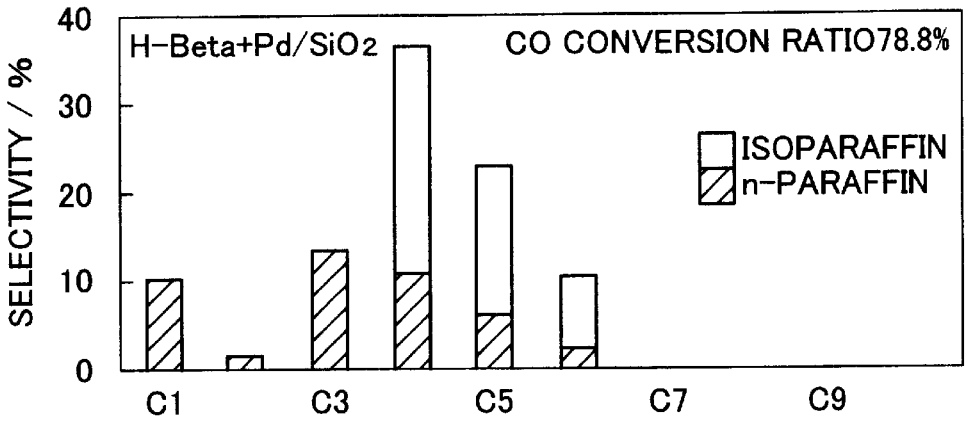
FIG. 9 is a graphical representation showing the selectivity (%) for respective types of hydrocarbons when H-β is used as a solid acid catalyst in the second reaction stage.

FIG. 6 shows the result obtained when H-mordenite (Mor) as one type of zeolite was used as the solid acid catalyst in the second reaction vessel 12 under the aforementioned reaction conditions. FIG. 7 shows the result obtained when H-ZSM-5 was used as the solid acid catalyst (zeolite) in a similar manner. FIG. 8 and FIG. 9 show the results obtained when H-USY and H-β (Beta), respectively, were used as the solid acid catalyst (zeolite) in a similar manner.

In the example of FIG. 6 in which H-mordenite as one type of zeolite was used as the solid acid catalyst, the proportion of long chain hydrocarbons whose carbon number is 7 (C7) or greater was relatively large because of low decomposition activation of H-mordenite. In the example of FIG. 7 in which H-ZSM-5 was used as the solid acid catalyst, the selectivity for light n-paraffins, for example, propane (C3) and n-butane (C4), was significantly high because of excessively high decomposition activation of the solid acid catalyst. In the case where H-ZSM-5 was used as the solid acid catalyst, therefore, the selectivity for lower isoparaffins of C4 to C6 was relatively low.

In comparison with the above examples, where H-USY was used as the solid acid catalyst as in the example of FIG. 8, the selectivity for lower isoparaffins having a carbon number of 4 to 6 (C4 to C6) was increased. It follows that H-USY is preferably used as the solid acid catalyst when the target product should contain a high proportion of lower isoparaffins having a carbon number of 4 to 6.

The selectivity for lower isoparaffins having a carbon number of 4 to 6 in the product was also increased where H-β was used as the solid acid catalyst, as shown in FIG. 9. It is, however, to be noted that the proportion of isobutane having a carbon number of 4 was particularly large, and the selectivity for propane was higher than that of H-USY.

It will be understood from the above results that H-USY zeolite is most suitably used as the solid acid catalyst for producing lower isoparaffins having a carbon number from 4 to 6.

In the examples of FIG. 6 through FIG. 9, palladium supported by silica serving as a hydrogenation catalyst, in addition to the aforementioned solid acid catalyst, is supplied to the second reaction vessel 12. As a result, olefins produced in the FT synthesis in the first reaction vessel 10 and hydrocracking in the second reaction are almost completely hydrogenated and converted to saturated hydrocarbons. This makes it possible to prevent tar from being produced on the catalyst surface due to polymerization of the olefins, thus suppressing otherwise possible deterioration in the activation of the catalyst with time. If the hydrogenation catalyst were not added, the catalytic activation of the solid acid catalyst would greatly deteriorate with a lapse of the reaction time, thus making it difficult to put the catalyst to practical use.

Figure 10:
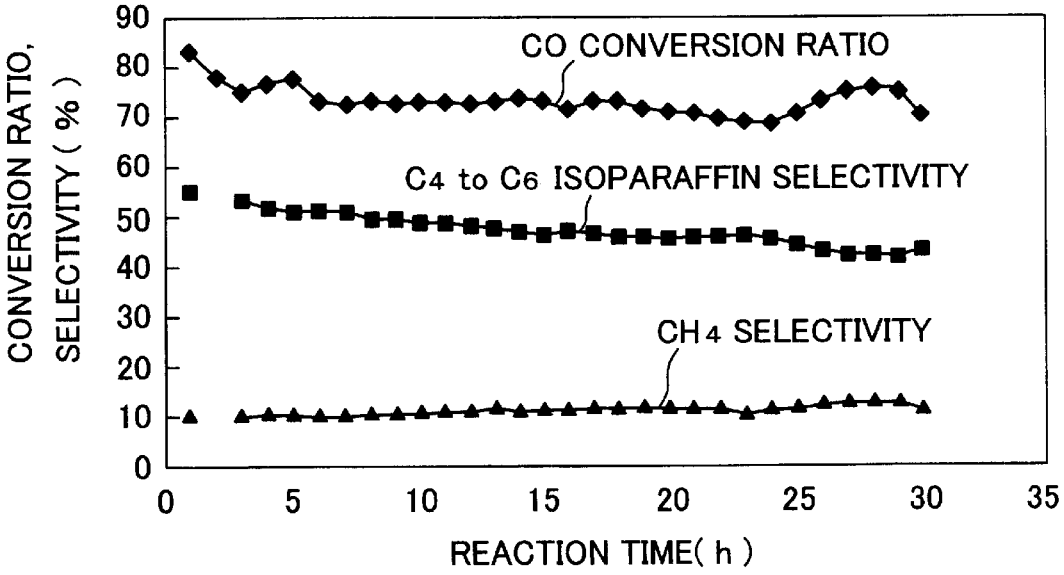
FIG. 10 is a graphical representation showing changes in the selectivity (%) for isoparaffins with time when palladium supported by silica is used as a hydrogenation catalyst in the second reaction stage.

FIG. 10 shows the selectivity (%) for isoparaffins having a carbon number of 4 to 6 in the second reaction vessel 12 in which H-β zeolite was used as the solid acid catalyst and palladium supported by silica was used as the hydrogenation catalyst. FIG. 10 also shows the conversion ratio of CO and the selectivity for methane ($CH_4$) in the first reaction vessel 10.

As shown in FIG. 10, the selectivity for isoparaffins with a carbon number of 4 to 6 was hardly reduced even where the reaction continued for as long as 30 hours. This indicates that the activity of the solid acid catalyst was hardly lost. This may be because the olefins are hydrogenated by the palladium supported by silica serving as the hydrogenation catalyst as described above, and therefore tar, which would otherwise be produced due to polymerization of the olefins, is prevented from being produced on the surface of the solid acid catalyst.

Figure 11:
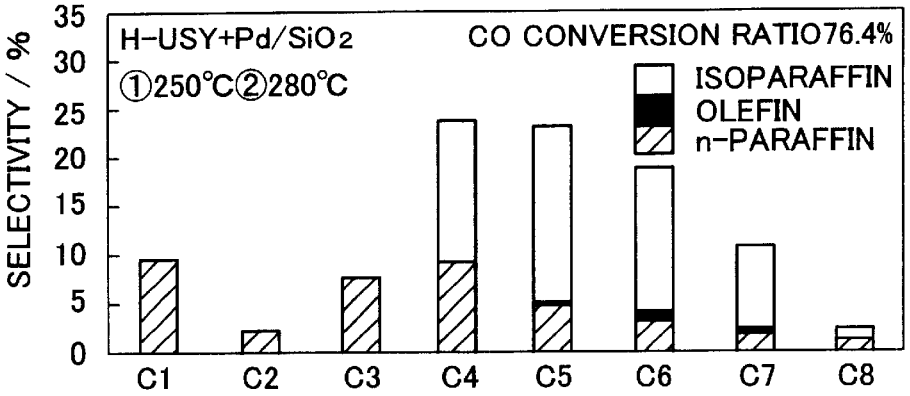
FIG. 11 is a graphical representation showing the selectivity (%) for respective types of hydrocarbons when the reaction temperature was controlled to 250° C. in the first reaction stage and controlled to 280° C. in the second reaction stage.
Figure 12:
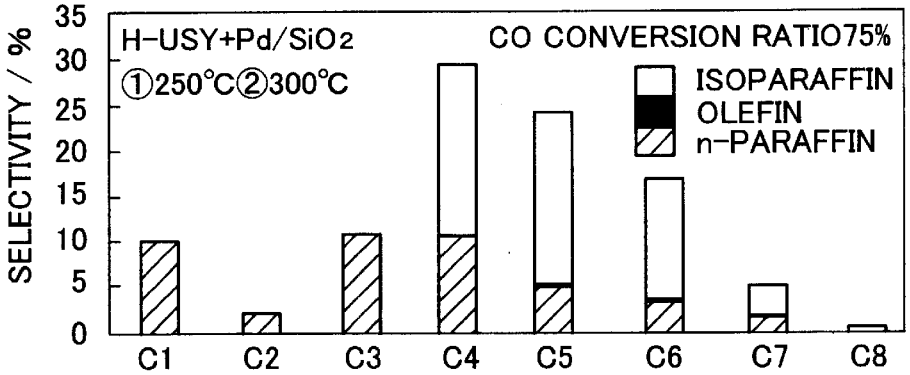
FIG. 12 is a graphical representation showing the selectivity (%) for respective types of hydrocarbons when the reaction temperature was controlled to 250° C. in the first reaction stage and controlled to 300° C. in the second reaction stage.
Figure 13:
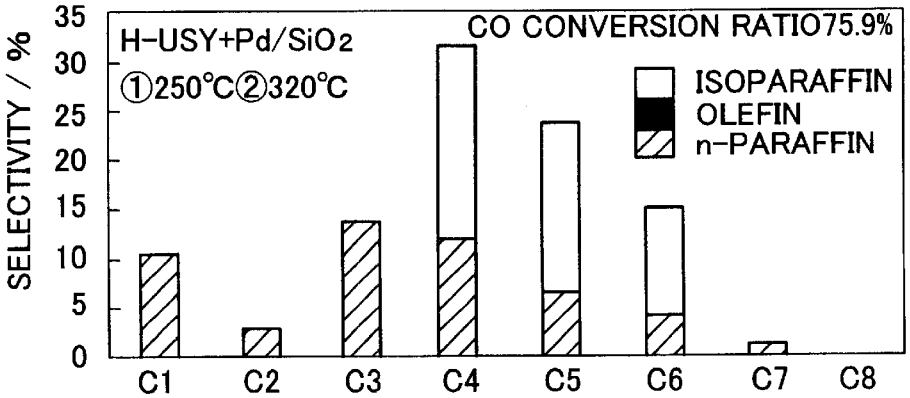
FIG. 13 is a graphical representation showing the selectivity (%) for respective types of hydrocarbons when the reaction temperature was controlled to 250° C. in the first reaction stage and controlled to 320° C. in the second reaction stage.

FIGS. 11 to 13 show the selectivity (%) of the product in the case where the reaction temperature in the first reaction vessel 10 was kept constant, i.e., at 250° C. while the reaction temperature in the second reaction vessel 12 was varied.

More specifically, the temperature in the second reaction vessel 12 was controlled to 280° C. in the example of FIG. 11, to 300° C. in the example of FIG. 12, and to 320° C. in the example of FIG. 13. In these examples, the catalyst obtained by mixing H-ZXM-5 serving as a solid acid catalyst with cobalt supported by silica serving as a FT synthesis catalyst was used in the first reaction vessel 10, and the catalyst obtained by mixing palladium supported by silica serving as a hydrogenation catalyst with H-USY zeolite serving as a solid acid catalyst was used in the second reaction vessel 12. Furthermore, the reaction pressure was controlled to 10 atm, and the composition ratio of syngas supplied to the first reaction vessel 10, i.e., $H_2/CO$, was equal to 1.8. Also, the syngas was supplied to the first reaction vessel 10 in an amount of 0.2 mol per hour with respect to 1 gram of the FT synthesis catalyst.

It will be understood from FIGS. 11 to 13 that the selectivity for long chain hydrocarbons is reduced with an increase in the reaction temperature. By controlling the reaction temperature in the second reaction vessel 12 in this manner, the selectivity of the product for hydrocarbons having a particular carbon number may be controlled.

According to the invention as described above, the Fischer-Tropsch synthesis is carried out in the first stage, and hydrocracking and isomerization are carried out in the second stage, such that these reactions are conducted under the conditions most suitable for the respective catalysts. As a result, the selectivity for lower isoparaffins as a target product can be increased.

In the first reaction stage, a wax component produced in the FT synthesis can be quickly decomposed by the solid acid catalyst comprising zeolite which is mixed with the FT synthesis catalyst, and therefore the FT synthesis can be accomplished with high stability.

In the second reaction stage in which the solid acid catalyst mixed with the hydrogenation catalyst is used, olefins generated in the first-stage reaction are hydrogenated by the hydrogenation catalyst, and therefore polymerization of olefins can be prevented or suppressed. This can prevent deactivation of the catalyst due to tar that would result from polymerization of olefins on the solid acid catalyst. If hydrogen is added in the second reaction stage, the hydrogenation of the olefins can be further promoted or accelerated.

Although the invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A process for synthesis of lower isoparaffins from synthesis gas that is a mixture of hydrogen and carbon monoxide, comprising the steps of:

synthesizing straight chain hydrocarbons in a first stage by contacting the synthesis gas with a Fischer-Tropsch synthesis catalyst that is mixed with a solid acid catalyst for mainly hydrocracking long chain hydrocarbons; and synthesizing isoparaffins in a second stage by contacting the straight chain hydrocarbons synthesized in the first stage, with a mixture of a hydrogenation catalyst for hydrogenating olefins and a solid acid catalyst for hydrocracking and isomerizing the straight chain hydrocarbons.

2. The process as defined in claim 1, wherein the Fischer-Tropsch synthesis catalyst comprises one selected from the group consisting of cobalt (Co) supported by silica and $CoMnO_2$prepared by a coprecipitation method.

3. The process as defined in claim 1, wherein the hydrogenation catalyst comprises one of paradium (Pd) and platinum (Pt) supported by silica.

4. The process as defined in claim 1, wherein the hydrogenation catalyst comprises one of paradium (Pd) and platinum (Pt) directly supported by the solid acid catalyst.

5. The process as defined in claim 1, further comprising the step of adding hydrogen to the second stage in which the isoparaffins are synthesized.

6. The process as defined in claim 1, wherein synthesis of the straight chain hydrocarbons in the first stage is carried out at a temperature in a range of 240 to 260° C., and synthesis of the isoparaffins in the second stage is carried out at a temperature in a range of 280 to 320° C.

7. The process as defined in claim 2, wherein the hydrogenation catalyst comprises one of paradium (Pd) and platinum (Pt) supported by silica.

8. The process as defined in claim 2, wherein the hydrogenation catalyst comprises one of paradium (Pd) and platinum (Pt) directly supported by the solid acid catalyst.

9. The process as defined in claim 2, further comprising the step of adding hydrogen to the second stage in which the isoparaffins are synthesized.

10. The process as defined in claim 2, wherein synthesis of the straight chain hydrocarbons in the first stage is carried out at a temperature in a range of 240 to 260° C., and synthesis of the isoparaffins in the second stage is carried out at a temperature in a range of 280 to 320° C.

11. The process as defined in claim 3, further comprising the step of adding hydrogen to the second stage in which the isoparaffins are synthesized.

12. The process as defined in claim 3, wherein synthesis of the straight chain hydrocarbons in the first stage is carried out at a temperature in a range of 240 to 260° C., and synthesis of the isoparaffins in the second stage is carried out at a temperature in a range of 280 to 320° C.

13. The process as defined in claim 5, wherein synthesis of the straight chain hydrocarbons in the first stage is carried out at a temperature in a range of 240 to 260° C., and synthesis of the isoparaffins in the second stage is carried out at a temperature in a range of 280 to 320° C.

14. The process as defined in claim 7, further comprising the step of adding hydrogen to the second stage in which the isoparaffins are synthesized.

15. The process as defined in claim 7, wherein synthesis of the straight chain hydrocarbons in the first stage is carried out at a temperature in a range of 240 to 260° C., and synthesis of the isoparaffins in the second stage is carried out at a temperature in a range of 280 to 320° C.

16. The process as defined in claim 9, wherein synthesis of the straight chain hydrocarbons in the first stage is carried out at a temperature in a range of 240 to 260° C., and synthesis of the isoparaffins in the second stage is carried out at a temperature in a range of 280 to 320° C.

17. The process as defined in claim 11, wherein synthesis of the straight chain hydrocarbons in the first stage is carried out at a temperature in a range of 240 to 260° C., and synthesis of the isoparaffins in the second stage is carried out at a temperature in a range of 280 to 320° C.

18. The process as defined in claim 14, wherein synthesis of the straight chain hydrocarbons in the first stage is carried out at a temperature in a range of 240 to 260° C., and synthesis of the isoparaffins in the second stage is carried out at a temperature in a range of 280 to 320° C.

* * * * *